US010603772B2

(12) United States Patent
Yelton

(10) Patent No.: US 10,603,772 B2
(45) Date of Patent: Mar. 31, 2020

(54) CLIP REMOVAL TOOL

(71) Applicant: HONDA MOTOR CO., LTD., Tokyo (JP)

(72) Inventor: James Yelton, North Rushsylvania, OH (US)

(73) Assignee: HONDA MOTOR CO., LTD., Tokyo (JP)

( * ) Notice: Subject to any disclaimer, the term of this patent is extended or adjusted under 35 U.S.C. 154(b) by 113 days.

(21) Appl. No.: 15/717,476

(22) Filed: Sep. 27, 2017

(65) Prior Publication Data

US 2019/0091843 A1 Mar. 28, 2019

(51) Int. Cl.
*B25B 27/14* (2006.01)
*B25B 27/00* (2006.01)

(52) U.S. Cl.
CPC ..... *B25B 27/14* (2013.01); *B25B 27/0035* (2013.01)

(58) Field of Classification Search
CPC ..... B25B 27/14; B25B 27/0035
See application file for complete search history.

(56) References Cited

U.S. PATENT DOCUMENTS 2,341,063 A 2/1944 Tinnerman
3,314,320 A 4/1967 Early
3,751,785 A 8/1973 Whitesell
4,841,821 A 6/1989 Cooper
5,884,900 A 3/1999 Gobeil et al.
6,324,741 B1 12/2001 Brown
6,786,472 B1 9/2004 Dahl
6,893,004 B2 5/2005 Ploeger
7,735,806 B2 6/2010 Prater et al.
7,753,402 B2 7/2010 Volkmann et al.
8,595,911 B2 * 12/2013 Hendren ..... B25B 31/00 29/260
9,505,111 B2 11/2016 Dorsey
2008/0315577 A1 12/2008 Pavnaskar et al.
2015/0107077 A1 4/2015 Hanson

FOREIGN PATENT DOCUMENTS

EP 2 815 847 A1 12/2014

* cited by examiner

*Primary Examiner* — John C Hong
(74) *Attorney, Agent, or Firm* — Arent Fox LLP

(57) ABSTRACT

Examples in the disclosure relate to an apparatus and method for removing a push clip from a panel. The apparatus may include a longitudinal body and a contact block having a surface transverse to the longitudinal body. The contact block may include an opening through the contact block having an inner diameter substantially corresponding to an outer diameter of a shaft of the push clip. The apparatus may include a pushrod slidably mounted to the longitudinal body and movable through the opening. An operator may align the removal tool with the shaft. The operator may then advance the removal tool longitudinally over the shaft until the contact block contacts the panel. The operator may then advance the pushrod distally to remove the push clip from the panel.

11 Claims, 4 Drawing Sheets

CLIP REMOVAL TOOL

BACKGROUND

Various vehicle components may be assembled using push clips. In general, a push clip has a hollow shaft extending from a flat head. The hollow shaft includes gaps that allow one or more retractable arms to extend outside of the shaft. In order to join two flat panels, holes in the panels may be aligned, and the hollow shaft may be pushed through the aligned holes. Once the retractable arms have cleared the panels, the retractable arms may expand outward and prevent the shaft from returning through the holes by engaging a surface of a panel.

Such push clips may be beneficial during vehicle assembly because they can be installed quickly and easily without tools. For example, push clips may be used to fasten decorative plastic parts to metal panels. The push clips, however, may be difficult to remove. Typically, push clips are removed by using a tool such as pliers to squeeze the retractable arms back into the gaps. The pliers, however, may then contact the panel surface and prevent the clip from being returned through the holes. Additionally, exerting longitudinal force on the pliers while also exerting a compressive force may be difficult for an operator. In some cases, a separating force is applied between the panels to urge the clip back through the holes, and then the retractable arms are compressed to allow the push clip to return through the holes. Such separating forces, however, may damage one or both of the panels, resulting in a scrapped part.

In view of the foregoing, there is a need for techniques for removal of push clips. Further advantages will become apparent from the disclosure provided below.

SUMMARY

This summary is provided to introduce a selection of concepts in a simplified form that are further described below in the DETAILED DESCRIPTION. This summary is not intended to identify key features of the claimed subject matter, nor is it intended to be used as an aid in determining the scope of the claimed subject matter.

In an aspect, the disclosure provides an apparatus for removing a push clip having retractable arms extending from a shaft. The apparatus may include a longitudinal body. The apparatus may include a contact block having a surface transverse to the longitudinal body and an opening defined therein. An inner diameter of the opening may substantially corresponding to an outer diameter of the shaft. A pushrod may be slidably mounted to the longitudinal body and movable through the opening.

In another aspect, the disclosure provides a method of removing, from a panel, a push clip having retractable arms extending from a shaft. The method may include compressing the retractable arms of the push clip using a first portion of a tool. The method may include applying a force to move the push clip in a first direction using a second portion of the tool.

BRIEF DESCRIPTION OF THE DRAWINGS

The novel features believed to be characteristic of the disclosure are set forth in the appended claims. In the descriptions that follow, like parts are marked throughout the specification and drawings with the same numerals, respectively. The drawing figures are not necessarily drawn to scale and certain figures may be shown in exaggerated or generalized form in the interest of clarity and conciseness. The disclosure itself, however, as well as a preferred mode of use, further objects and advances thereof, will be best understood by reference to the following detailed description of illustrative aspects of the disclosure when read in conjunction with the accompanying drawings, wherein:

DETAILED DESCRIPTION

The following includes definitions of selected terms employed herein. The definitions include various examples and/or forms of components that fall within the scope of a term and that may be used for implementation. The examples are not intended to be limiting.

A "vehicle," as used herein, refers to any moving vehicle that may be capable of carrying one or more human occupants and is powered by any form of energy. The term "vehicle" includes, but is not limited to: cars, trucks, vans, minivans, SUVs, motorcycles, scooters, boats, personal watercraft, and aircraft. In some cases, a motor vehicle includes one or more engines.

Generally described, the present disclosure provides a tool for removing a push clip from one or more panels. Generally, the push clip extends through an opening of each panel and is retained by retractable arms extending beyond the opening. An example removal tool includes a handle and longitudinal shaft connected to a contact block. The contact block includes an opening having an inner diameter corresponding to the outer diameter of a shaft of the push clip. A pushrod is slidably mounted to the longitudinal shaft.

To remove the push clip, the opening may be advanced over the shaft of the push clip to retract the retractable arms into the shaft of the push clip. The pushrod may then be advanced to contact the tip of the shaft and push the clip back through the opening. Once the retractable arms have cleared the panel, the tool may be used to remove another push clip.

Figure 1:
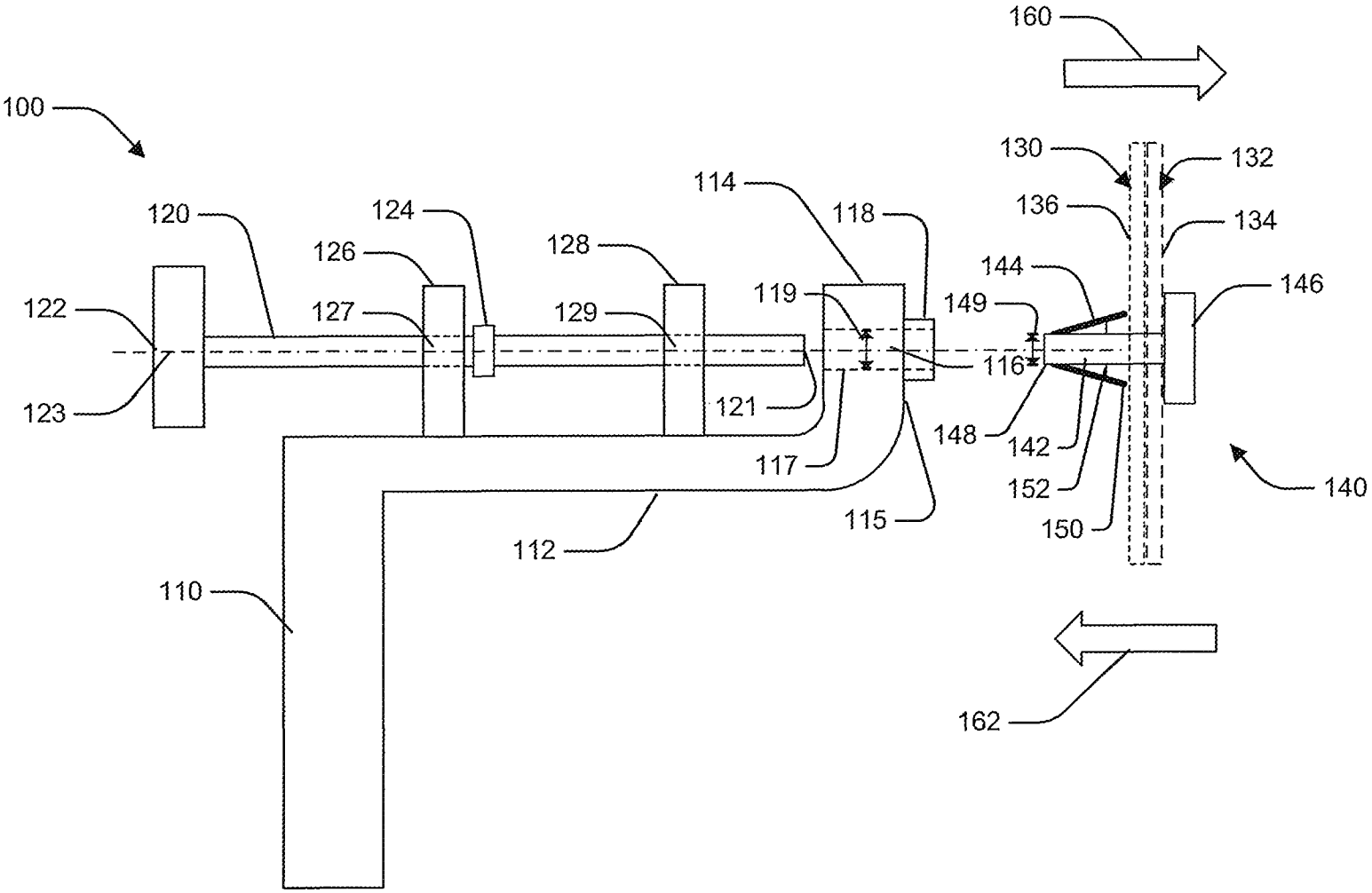
FIG. 1 is a side view showing an example clip removal tool and push clip, according to an aspect of the disclosure.

Turning to FIG. 1, an example clip removal tool 100 may be used to remove a push clip 140. The push clip 140 may include a hollow shaft 142, retractable arms 144, and a head 146. The retractable arms 144 may be fixed at a distal end 148 of the push clip 140 and free at an end 150 proximal to the head 146. The retractable arms 144 may be biased outward by a biasing member 152 such as a leaf spring. The push clip 140 may be positioned through one or more generally flat sheets. For example, a push clip 140 may be used to mount a plastic panel 132 to a metal panel 130. The push clip 140 may be removed by moving the push clip 140 in a first direction 160. The push clip 140 may have been installed by pressing the push clip 140 through aligned holes of the panels 132, 130 in a second direction 162, opposite the first direction 160, from a side 134 of the plastic panel 132. The retractable arms 144 may be compressed within the aligned holes as the distal end 148 of the push clip 140 is inserted. Once the free ends 150 of the retractable arms 144 clear the metal panel 130, the retractable arms 144 may expand outward. The retractable arms 144 may prevent the push clip 140 from being withdrawn in the first direction 160 by contacting a surface 136 of the metal panel 130. Although one design of push clip is illustrated, it should be appreciated that other push clip designs operate in a similar manner and may likewise be removed by the clip removal tool 100.

The clip removal tool 100 may include a handle 110 connected to a longitudinal body 112 that supports a contact block 114. In the illustrated example, the handle 110 may be oriented transverse to the longitudinal body 112. For example, the handle 110 may be substantially perpendicular to the longitudinal body (e.g., preferably within 10 degrees of perpendicular). For ergonomic reasons, the handle 110 may provide a pistol-type grip that allows a user to extend the clip removal tool 100 in the first direction 160 and apply pressure using large muscles such as the pectoral muscles, triceps, and deltoids. The longitudinal body 112 may be integrally formed with one or both of the handle 110 and contact block 114. The contact block 114 may include a surface 115 oriented transverse to the longitudinal body 112. For example, the surface 115 of the contact block 114 may be oriented at a substantially right angle to the longitudinal body 112.

Figure 2:
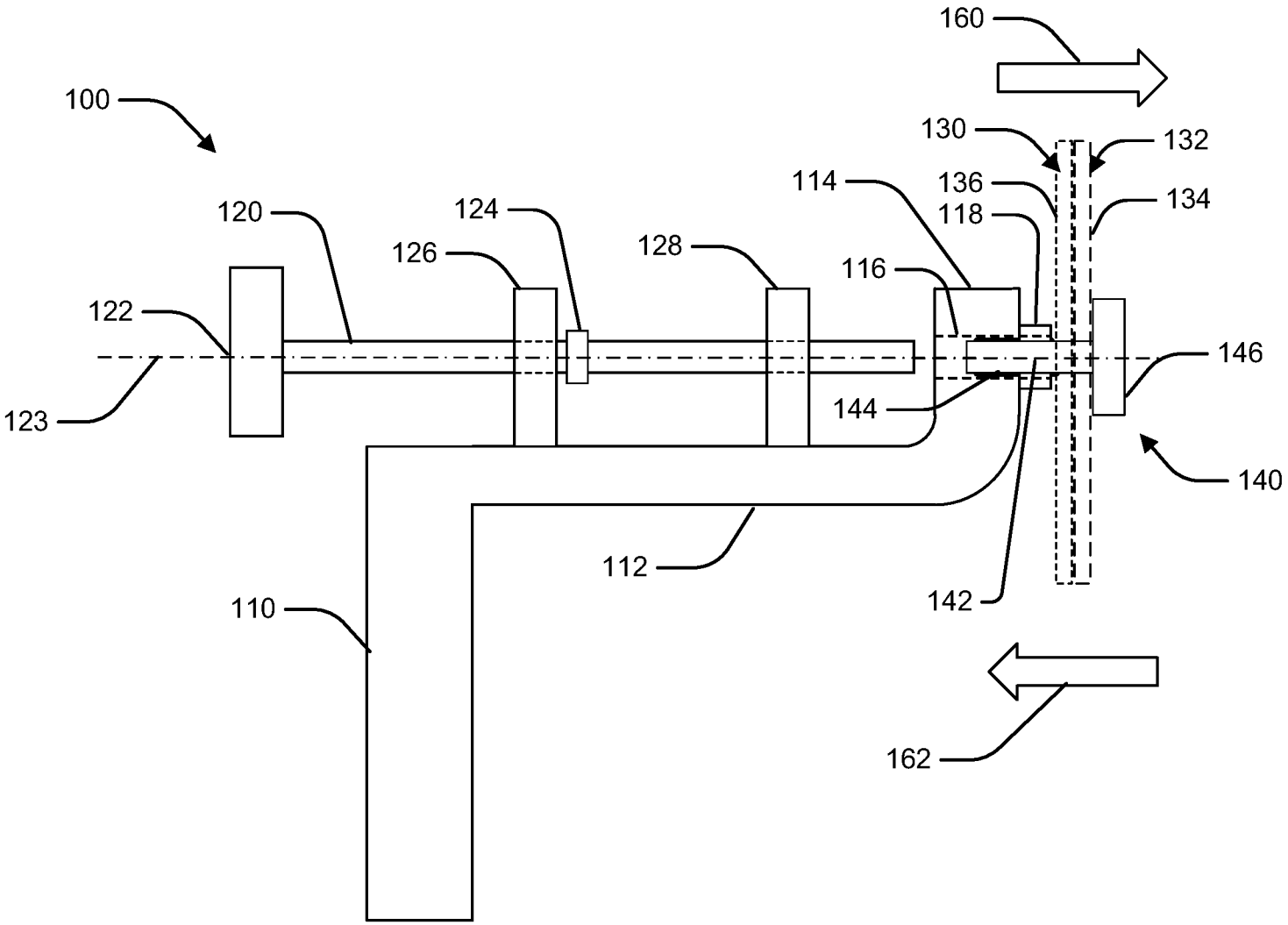
FIG. 2 is a side view showing the example clip removal tool of FIG. 1 mounted on the push clip.

The contact block 114 may include an opening 116 defined therein by a wall 117. The opening 116 may form a through hole in the contact block 114 with a circular cross section. The opening 116 may have an inner diameter 119 that corresponds to an outer diameter 149 of the shaft 142 of the push clip 140. For example, the inner diameter 119 of the opening 116 may be slightly larger (e.g., 1% to 10%, preferably less than 5%) than the outer diameter 149 of the shaft 142. Accordingly, when the contact block 115 is advanced over the shaft 142, as best seen in FIG. 2, the wall 117 of the opening 116 may force the retractable arms 144 into the shaft 142. Because the opening 116 is circular, each of the retractable arms 144 may be compressed concurrently. In an aspect, the contact block 114 may include a washer 118. The washer 118 may be made of a soft material (e.g., rubber) that will prevent damage to the surface of the panel 130. The washer 118 may have an inner diameter that is substantially the same as the inner diameter of the opening 116. The washer 118 may also compress the retractable arms 144.

In the exemplary embodiment, clip removal tool 100 includes a first flange 126, a second flange 128, and a pushrod 120. Pushrod 120 may be mounted to the longitudinal body 112. The pushrod 120 may be aligned with the opening 116 and slidably extend into and through the opening 116. The pushrod 120 may include a handle 122 having a flat surface that provides a grip for extending the pushrod 120. In an aspect, the pushrod 120 may be mounted to the longitudinal body 112 by flanges 126, 128. The flanges 126, 128 may extend transversely from the longitudinal body 112. The flanges 126, 128 may include through openings 127, 129 that retain the pushrod 120. The pushrod 120 may also include a stop 124 located between the flanges 126, 128 that limits longitudinal movement of the pushrod 120. For example, the stop 124 may prevent the pushrod 120 from sliding out of the flanges 126 when the tool 100 is held vertically.

Figure 3:
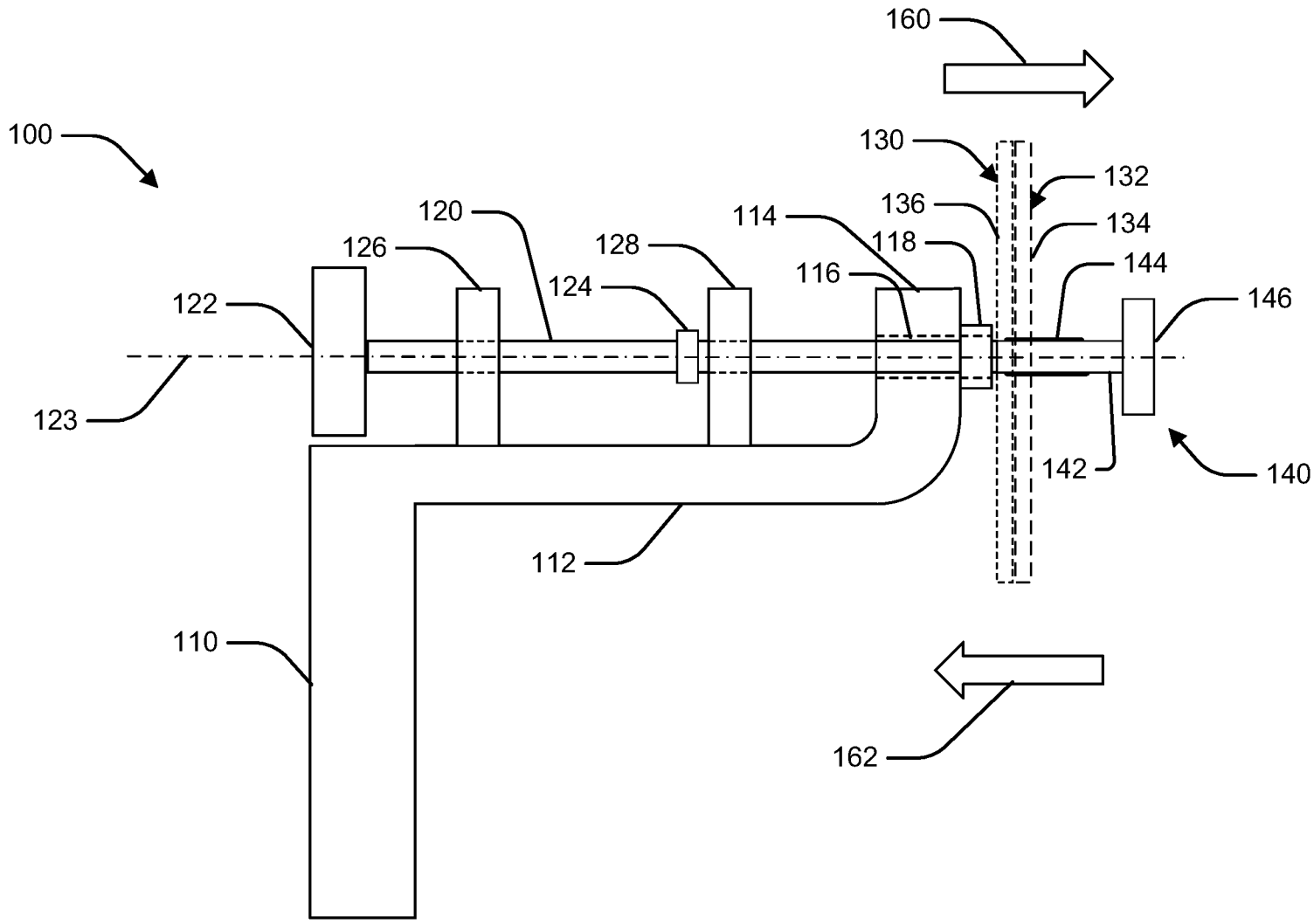
FIG. 3 is a side view showing the example clip removal tool of FIG. 1 engaging the push clip.

FIG. 3 is a side view showing the example clip removal tool 100 engaging the push clip 140. The pushrod 120 may be advanced by pushing on the handle 122. For example, an operator may hold the tool 100 by the handle 110 with one hand and push on the handle 122 with the other hand. A tip 121 of the pushrod 120 may contact the distal end 148 of the shaft 142. Because the opening 116 has compressed the retractable arms 144, the retractable arms 144 may enter the hole of the panel 130, and the push clip 140 may travel in the first direction 160 toward the head 146. That is, the pushrod 120 may cause the push clip 140 to back out of the panels 130, 132. Accordingly, the push clip 140 may be removed from the panels 130, 132. The panels 130, 132 may then be separated.

Figure 4:
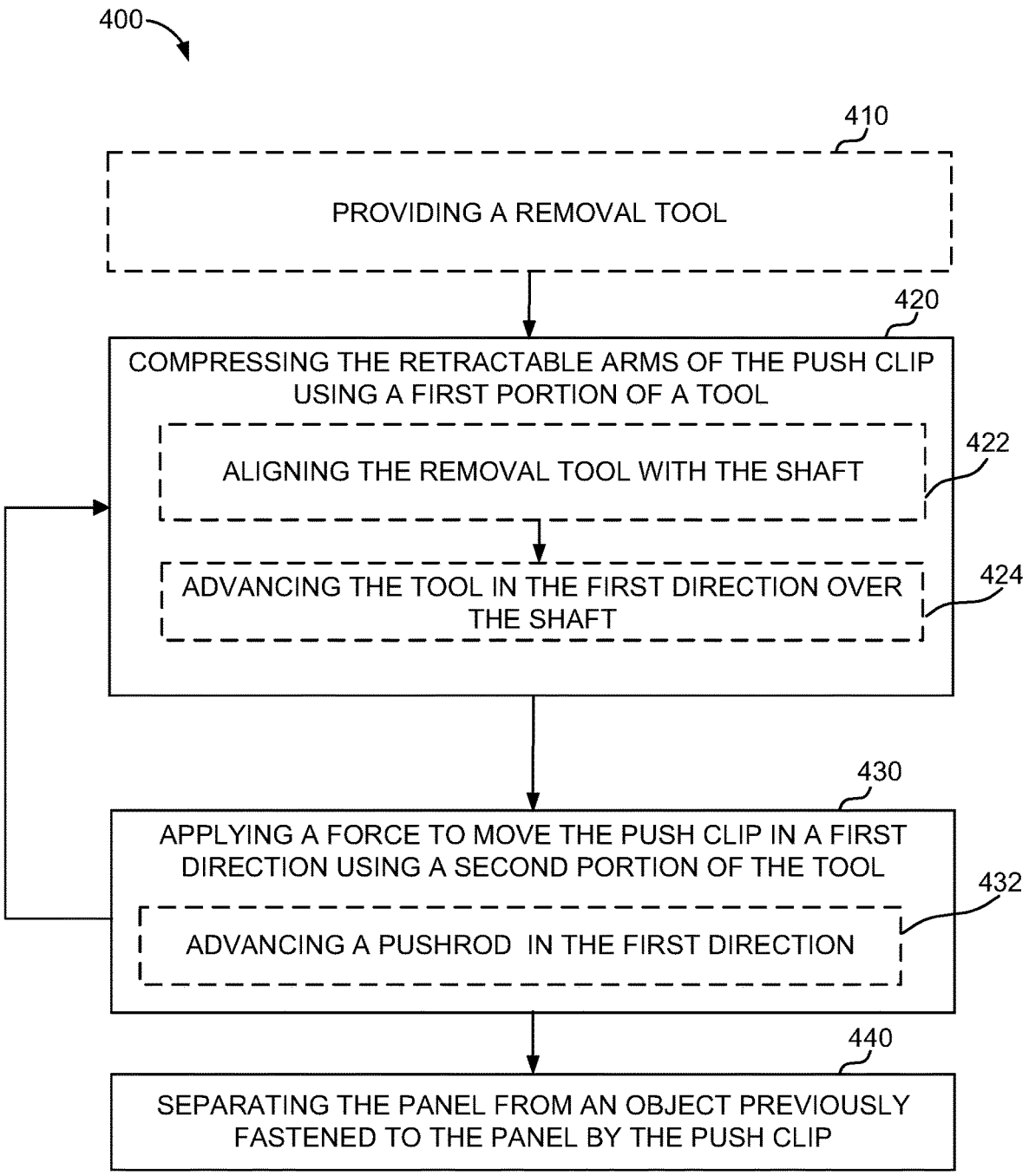
FIG. 4 is a flowchart showing an example method of removing a push clip from a panel.

FIG. 4 is a flowchart showing an example method 400 for removing a push clip from a panel. The method 400 may be performed by an operator using the tool 100.

At block 410, the method 400 may optionally include providing a removal tool. In an aspect, for example, the removal tool may be the removal tool 100. The removal tool 100 may include a handle 110, a longitudinal body 112 extending from the handle, a contact block 114 having a surface 115 transverse to the longitudinal body and an opening therein having an inner diameter substantially corresponding to an outer diameter of the shaft. The removal tool 100 may include a pushrod 122 slidably mounted to the longitudinal body 112 and movable through the opening 116.

At block 420, the method 400 may include compressing the retractable arms of the push clip using a first portion of a tool. For example, the operator may compress the retractable arms of the push clip using the opening 116 through the contact block 114 of the tool 100. For example, at block 422, the block 420 may optionally include aligning the removal tool with the shaft. For example, the operator may align the removal tool 100 with the shaft 142. The operator may hold the removal tool by the handle 110 and place the contact block 114 near the shaft 142 such that the distal end 148 of the shaft 142 is on an axis 123 passing through the opening 116. At block 424, the block 420 may optionally include advancing the removal tool in the first direction over the shaft. For example, the operator may advance the removal tool 100 in the first direction 160 over the shaft 142. In an aspect, the operator may advance the removal tool 100 until the contact block 114 contacts the panel 130. The operator may advance the removal tool 100 by extending his or her arm, allowing sufficient pressure to be applied to the retractable arms by the wall 117 of the opening 116. In an aspect, as the removal tool is advanced, the wall 117 may compress the retractable arms within the opening 116. For example, advancing the removal tool 100 over the shaft 142 may compress the retractable arms 144 within the opening 116 if the inner diameter 119 of the opening 116 is slightly larger than the outer diameter 149 of the shaft 142.

In block 430, the method 400 may include applying a force to move the push clip in a first direction using a second portion of the tool. In an aspect, for example, the operator may apply a force to move the push clip 140 in the first direction 160 using the pushrod 120 of the removal tool 100. The longitudinal body 112 of the tool may remain stationary and abutting the panel 130. The pushrod 120 may move from a first position outside of the opening 116 to a second position at least partially within the opening 116. The push clip 140 may move in the first direction relative to the panels 130, 132. For example, at block 432, the method may optionally include advancing a pushrod in the first direction. In an aspect, for example, the operator may advance the pushrod 120 in the first direction by pushing on the handle 122. For example, the operator may hold the removal tool 100 with one hand and push on the handle 122 with the other hand. Using the second hand may allow the operator to easily supply sufficient force to remove the push clip 140. It should be noted that a lever or trigger could be added to advance the pushrod 120, but such a device may require the operator to use fine motor skill, which may be difficult while exerting force on the removal tool 100. After advancing the pushrod distally, the push clip 140 may fall out of the hole in the panels 130, 132. The push clip 140 may also remain within the hole, but exert little resistance to separation of the panels 130, 132. The method 400 may return to block 420 to remove an additional push clip 140 from the panels 130, 132.

In block 440, the method 400 may include separating the panel from an object previously fastened to the panel by the push clip. In an aspect, for example, the operator may separate the panel 130 from the panel 132. For example, the operator may pull the panel 132 away from the panel 130. Accordingly, the method 400 may allow separation of the panel 130 from the panel 132 without damaging either of the panels or the push clip 140.

Described herein are exemplary apparatus and methods for separating a first component from a second component after the first and second components have been coupled using press clips. More specifically, a tool is described that efficiently separates components coupled using press clips while minimizing damage to the components and press clips. Moreover, operation of the tool is an ergonomic improvement over known clip removal techniques.

It will be appreciated that various implementations of the above-disclosed and other features and functions, or alternatives or varieties thereof, may be desirably combined into many other different systems or applications. Also that various presently unforeseen or unanticipated alternatives, modifications, variations, or improvements therein may be subsequently made by those skilled in the art which are also intended to be encompassed by the following claims.

What is claimed is:

1. An apparatus for removing a push clip having retractable arms extending from a shaft, comprising:

a longitudinal body;

a contact block having a surface transverse to the longitudinal body and an opening defined therein, an inner diameter of the opening substantially corresponding to an outer diameter of the shaft; and a pushrod slidably mounted to the longitudinal body and movable through the opening.

2. The apparatus of claim 1, wherein the inner diameter is less than 10 percent larger than the outer diameter of the shaft.

3. The apparatus of claim 1 further comprising a handle extending from the longitudinal body.

4. The apparatus of claim 3, wherein the handle is oriented on an axis substantially perpendicular to the longitudinal body.

5. The apparatus of claim 1, wherein a diameter of the pushrod is substantially the same as the outer diameter of the shaft.

6. The apparatus of claim 1, further comprising at least two flanges extending from the longitudinal body, each flange having a through opening aligned with the opening through the contact block for slidably mounting the pushrod.

7. The apparatus of claim 6, further comprising a stop attached to the pushrod that limits longitudinal movement of the pushrod.

8. The apparatus of claim 1, wherein the opening within the contact block is configured to compress the retractable arms of the push clip when the shaft of the push clip is positioned within the opening.

9. The apparatus of claim 1, wherein the pushrod, in a first position, is not within the opening, and in a second position, is at least partially within the opening.

10. The apparatus of claim 1, wherein the pushrod is configured to apply a force to the shaft of the push clip, causing the shaft of the push clip to move with respect to the opening and with respect to a hole in which the push clip was installed.

11. The apparatus of claim 1, wherein the pushrod includes a handle having a flat surface for advancing the pushrod.

* * * * *